US012534812B2

(12) United States Patent
Ball et al.

(10) Patent No.: US 12,534,812 B2
(45) Date of Patent: Jan. 27, 2026

(54) CATHODIC PROTECTION OF CONCRETE USING AN ANODE ATTACHED TO AN OUTER SURFACE

(71) Applicant: Vector Corrosion Technologies Ltd., Winnipeg (CA)

(72) Inventors: John Chris Ball, Frankfort, KY (US); David Whitmore, Winnipeg (CA); Martin Beaudette, Winnipeg (CA); Gerald Bruce Hiebert, Winnipeg (CA); George Sergi, Walsall (GB); David Simpson, Harletbury (GB)

(73) Assignee: Vector Corrosion Technologies Ltd., Winnipeg (CA)

( * ) Notice: Subject to any disclaimer, the term of this patent is extended or adjusted under 35 U.S.C. 154(b) by 695 days.

(21) Appl. No.: 17/899,218

(22) Filed: Aug. 30, 2022

(65) Prior Publication Data

US 2024/0068110 A1 Feb. 29, 2024

(51) Int. Cl.
*C23F 13/14* (2006.01)
*C23F 13/20* (2006.01)

(52) U.S. Cl.
CPC ..... *C23F 13/14* (2013.01); *C23F 13/20* (2013.01); *C23F 2201/02* (2013.01)

(58) Field of Classification Search
CPC ..... C04B 2111/265; A23F 2201/02
See application file for complete search history.

(56) References Cited

U.S. PATENT DOCUMENTS 5,183,694 A 2/1993 Webb
5,968,339 A * 10/1999 Clear ..... C04B 41/72 204/196.24
9,382,631 B1 * 7/2016 Villegas ..... C23F 13/14
10,227,698 B2 3/2019 Goodwin

FOREIGN PATENT DOCUMENTS

EP 147977 7/1985

OTHER PUBLICATIONS

Bead, Merriam-Webster (Year: 2009).*

* cited by examiner

*Primary Examiner* — Alexander W Keeling
(74) *Attorney, Agent, or Firm* — Adrian D. Battison; Ade & Company Inc.; Ryan W. Dupuis

(57) ABSTRACT

An anode apparatus for mounting on an external surface of a concrete structure to provide cathodic protection of metal members in the concrete uses a pre-assembled body which is typically elongate carrying a longitudinal anode, which can be sacrificial or impressed current, together with a supporting material having a front face for attachment to the surface and an impermeable plastic covering material at the rear face covering the anode and the supporting material when the front face is attached to the surface of the concrete. A channel defined on the front face is arranged to receive a layer of a conformable ionically conductive adhesive material for attachment to the external surface. A distance of the edge of the covering material is arranged to be similar to a distance of the metal from the external surface such that wetting and drying effects of environmental moisture are the same for the anode as for the metal components.

23 Claims, 5 Drawing Sheets

CATHODIC PROTECTION OF CONCRETE USING AN ANODE ATTACHED TO AN OUTER SURFACE

The present invention relates to a method and apparatus for cathodically protecting reinforced concrete structures, such as the decks or substructures of bridges, wharfs and parking garages.

Steel corrosion, in steel reinforced concrete structures, is the result of electrical current flowing from one point of the steel reinforcement to another. Such corrosion is enhanced by moisture and salt contamination of the concrete. Conventional cathodic protection applies an external direct current to the steel reinforcement from a current distribution anode which is in intimate contact with the concrete surface. The current from the distribution anode counteracts the corrosive current. This can be provided by an anode strip applied to an external surface of the concrete.

In other arrangements, the anode comprises a strip or band of sacrificial anodic material. The strip or band has a pressure sensitive adhesive layer which can be a hydrogel which permits the strip or band to be adhesively secured directly to the structure. The adhesive layer is electrically conductive, and has a protective covering which permits the anode to be rolled up without adhesion between adjacent windings of the anode. Examples of adhesives disclosed in the patent are acrylic glues or vinyl glues.

In addition to strips or tapes, or sprayed systems of sacrificial metal applied to the surface of an object to be protected, it has also been known to cut channels into concrete and to place a sacrificial metal anode in the channel where for example a channel is into concrete near steel reinforcement and then magnesium or zinc anodes are placed into the channel. A resilient, preferably foam, material can be placed in the channel with the anode. This material can be compressed by the expansive corrosion products resulting from the corrosion of the sacrificial anode.

It is also known to apply a jacket surrounding a concrete column which includes an impressed current anode within the jacket.

SUMMARY OF THE INVENTION

It is an object of the present invention to provide an arrangement by which an anode can be attached simply and quickly to an exterior surface of a concrete structure and can operate to provide protection for an extended period without deterioration by environmental conditions including moisture. The exposed surface is typically a flat exterior surface but can include a groove or recess into which the anode is applied. The anode is typically a sacrificial anode but many of the features herein can also be used with impressed current anodes.

According to a first aspect there is provided an anode apparatus which is pre-assembled for mounting on an external surface of a concrete structure to provide cathodic protection for one or more metal components within the concrete structure, the pre-assembled anode apparatus comprising:

- a body having a front face for attachment to the external surface and a rear face facing away from the concrete structure;
- an anode carried on the body and extending at least partly therealong;
- the anode being formed of a material which is sacrificial relative to the metal components to generate a galvanic current between the anode and the metal components to provide cathodic protection of said one or more metal components;
- an ionically conductive supporting material carried on the body and at least partly surrounding the anode;
- the supporting material including an activator for maintaining the galvanic current;
- the supporting material having a front face arranged to allow communication of ions from the anode through the supporting material to the metal components in the concrete;
- the body including an impermeable covering material at the rear face covering the anode and the supporting material;
- the impermeable covering material being arranged to cover the anode and the supporting material when the front face is attached to the surface of the concrete.

According to a second aspect of the invention there is provided an anode apparatus which is pre-assembled for mounting on an external surface of a concrete structure to provide cathodic protection for one or more metal components within the concrete structure, the pre-assembled anode apparatus comprising:

- a body having a front face for attachment to the external surface and a rear face facing away from the concrete structure;
- an anode carried on the body and extending at least partly therealong;
- an ionically conductive supporting material carried on the body and at least partly surrounding the anode;
- the supporting material having a front face arranged to allow communication of ions from the anode through the supporting material to the metal components in the concrete;
- the body including an impermeable covering material at the rear face covering the anode and the supporting material;
- and a channel defined on the body between the front face of the supporting material and the surface for receiving an adhesive material applied into the channel for attachment of the front face to the surface by the adhesive material;
- the impermeable covering material being arranged to cover the anode and the supporting material when the front face is attached to the surface of the concrete.

According to a further aspect of the invention there is provided a method for cathodic protection for one or more metal components within a concrete structure where the one or more metal components are spaced from an exposed surface of the concrete, the method comprising:

- mounting on the exposed surface of the concrete structure a body having a front face for attachment to the exposed surface and a rear face facing away from the concrete structure;
- the body including an anode carried on and extending at least partly therealong;
- the anode being formed of a material which is sacrificial relative to the metal components to generate a galvanic current between the anode and the metal components to provide cathodic protection of the metal components;
- an ionically conductive supporting material carried on the body and at least partly surrounding the anode;
- the supporting material including an activator for maintaining the galvanic current;
- the supporting material having a front face arranged to allow communication of ions from the anode through the supporting material into the concrete to the metal components in the concrete;

and covering the supporting material and the anode with an impermeable covering material arranged to cover the anode and the supporting material when the front face is attached to the surface of the concrete.

According to a further aspect of the invention there is provided a method for cathodic protection for one or more metal components within a concrete structure, the method comprising:

mounting on the exposed surface of the concrete structure a preformed body having a front face for attachment to the exposed surface and a rear face facing away from the concrete structure;

the preformed body including an anode carried on and extending at least partly therealong;

the preformed body including a an ionically conductive supporting material carried at least partly surrounding the anode;

the supporting material having a front face arranged to allow communication of ions from the anode through the supporting material into the concrete to the metal components in the concrete;

attaching the front face to the concrete structure using an ionically conductive adhesive material;

the supporting material and the anode being covered with an impermeable covering material arranged to cover the anode, the supporting material and the adhesive material when the front face is attached to the surface of the concrete structure;

where the impermeable covering material extends beyond the anode, the supporting material and the adhesive material on either side.

In the method, the distance from the anode material to an edge of the covering material is arranged to approximately match a distance of the metal components from the surface of the concrete structure such that wetting and drying effects through the concrete are the same for the anode as for the metal components. This distance is an approximate match in that the distances may not be exactly the same since the porosity and drying characteristics of the concrete and the material adjacent the anode may be different but the intention is that the moisture conditions are maintained approximately equal to maintain a suitable resistance between the anode and the metal components.

The body can be and is typically an elongate body arranged to be mounted on and extend along one exposed surface of the concrete structure such as on a column or post but alternatively the body can be rectangular or even circular to be applied in effect as a patch over a particular area.

This arrangement therein makes use of the natural wetting and drying cycles that the steel reinforced concrete element is experiencing. If the steel is lying within a minimum depth of cover and is experiencing corrosion, it is evident that moisture is available at the particular depth. As mentioned above, the galvanic anode should also lie at least at the same depth, which of course cannot be the case if it is positioned on the concrete surface. A novel way disclosed herein of artificially achieving an equivalent cover as the steel reinforcement is to contain the anode in a water-proof impermeable housing or layer, fixed to the surface of the concrete, that extends beyond the anode on either side by a length equivalent to or otherwise proportional to the cover depth between the surface and the steel. Wetting and drying effects are then the same for the anode as for the steel which lies at the same distance away from the surface of the concrete.

In addition to the above problem of differential drying of the ionically conductive material at the anode and at the steel, the covering layer can also provide advantage that it reduces the potential leaching of the activator from the ionically conductive material at the anode. The activator is used to maintain current when using a sacrificial anode and can be washed out from the area around the anode when the anode is exposed to external moisture.

Yet further the covering layer can reduce carbonation where a carbonate is formed in the high pH conditions surrounding the anode. Both of these problems can significantly reduce the ability of a sacrificial anode to galvanically generate the necessary current for the cathodic protection.

In a preferred arrangement there is provided a fastening arrangement for attachment of the front face of the supporting material to the surface of the concrete. This can include fasteners such as screws engaging into the concrete. As the supporting material is typically a solid mortar in the preassembled structure, it is desirable that the fastening arrangement include a conformable material located between the front face and the surface to take up any inconsistencies in the surfaces. The fastening material therefore preferably includes a conformable adhesive material which bonds both to the front surface and the surface of the concrete while filling any inconsistencies between the surfaces.

The adhesive material can be provided as an integral part of the preassembled structure, typically covered by a release sheet, or more preferably the fastening arrangement includes a channel for receiving an adhesive which can be trowelled into the channel on site. In this way, the user can apply the adhesive as a fresh material which is provided at the required amount or quantity to properly attach and fill the area between the supporting material and the surface.

Preferably the channel is defined by longitudinally extending spaced side edges on either side of the front face of the supporting material with a bead arranged on each side to confine the adhesive therebetween. This enables the user to quickly and easily apply the required amount of the adhesive material between the two beads. Preferably the covering layer includes two outer cover portions outside the stop beads or edges to contain the adhesive and extending outwardly from the beads to cover any adhesive escaping or squeezed from the layer applied between the beads. This helps the user easily apply the required amount of the adhesive and acts to contain and cover any excess to provide a clean finished appearance when the body is applied to the exterior of the concrete.

Preferably the impermeable covering material is formed of an extruded plastic strip which is semi-rigid so as to lie flat on the surface of the concrete when applied and has a raised center section under which the supporting material and anode is housed and two side extending flange sections arranged on either side of the center section for engaging the surface. The raised center section has a volume sufficient to house the anode strip spaced from the surface of the concrete and to contain a required volume of the supporting material to provide a required level of activator in the material to maintain the activity of the anode.

Preferably the plastic strip forming the impermeable covering material includes flanges or fins extending into and engaging the supporting material for maintaining the supporting material and the anode carried thereby properly within the area of the raised section during handling, transportation and installation of the body onto the concrete surface.

While the body can be attached to the concrete solely by the adhesive layer above, in some cases the plastic covering material includes fastener holes at locations thereon spaced from the supporting material on either side. The attachment can thus be made more secure by screw fasteners which can pass through the holes to engage the concrete.

In other cases, the conformable material between the front face of the supporting material and the surface of the concrete can just be a filler which provides the necessary ionically conductive path between the supporting material and the concrete surface.

The arrangement herein is intended for use as a strip applied separately to an external surface of the concrete with the remainder of the surface remaining exposed. Thus the side edges of the strip are generally spaced from and are not attached to adjacent strips. In some cases the strips can be arranged end to end to provide a suitable length to cover a length of the structure to be protected. In other cases the length can be selected to meet the requirement using a single body or strip.

The anode includes one or more connector wires extending from an end of the anode for connection to another section of anode or to the steel when a sacrificial anode material or for connection to another section of anode material or to a power supply when used as an impressed current anode.

A longitudinal cavity in the covering material can be provided to receive the connecting wires from the anode.

In order to provide a clean appearance by covering the wires, a separate end cover is arranged to engage onto the impermeable covering material and cover an end face of the impermeable covering material at one end of the elongate body and the wires at the end. Preferably the end cover includes engagement lips for attachment to the plastic covering material by sliding onto the plastic cover from one end or as a snap fastening thereon.

Where the bodies are used end to end, the end cover is arranged to bridge across ends to cover the wires connecting therebetween.

In some cases where an accurate alignment body on the concrete structure is not required, the body can simply be applied using the above defined fastening arrangements. However where an accurate location is required, there can be provided an alignment member for prior attachment to the concrete at a required selected location. This can include at least one mounting leg extending along the concrete surface in a direction longitudinally of the intended location of the elongate body. In this way the alignment member is attached first and defines a mounting for attachment to and support of the elongate body on the concrete. When accurately located, the attachment can be completed using the adhesive and/or the fastening screws described above to hold the full length of the body in engagement with the concrete surface.

Preferably the impermeable body includes at least one cavity therein at or adjacent the concrete surface to retain moisture which may be longitudinally extending of provided at spaced locations.

The arrangement described herein can be used for impressed current anodes. However in regard to sacrificial anodes, it has particular advantage in that it is known that atmospherically exposed concrete loses moisture by evaporation and vapour transport through the exposed faces during relatively dry periods and gains moisture mainly by water absorption through the capillaries during wet periods. Vapour transfer can also occur through the exposed faces if the ambient humidity is significantly higher than that within the outer capillary pores. Water absorption is rapid and carries with it soluble agents, such as chlorides, which are aggressive to the steel reinforcement. Natural exposure studies involving a range of concrete types exposed to sea spray, showed that absorption and capillary suction were the predominant mechanisms of water (and hence chloride) uptake in the first 1-2 cm while ionic diffusion, which is a considerably slower process, was the main long-term migration mechanism further into the concrete. In a separate study on the effect of seawater spray, it was found that the first 1-2 cm of concrete were rapidly penetrated by chloride-bearing water. Recent field investigations have tended to support the observation that absorption can be an important ingress mechanism in concrete structures.

Studies have further revealed that capillary suction forces are large and will result in a rapid movement of water into a dry exposed concrete surface. With time, the rate of penetration or volume gain decreases owing to decreasing capillary forces caused by the increasing degree of saturation. It was further shown that a saturation or moisture gradient would exist over a few millimetres or centimetres into the concrete.

Capillary suction is therefore the main mechanism of liquid penetration in exposed concrete when it comes in contact with water following a dry period. Chlorides dissolved in the water will be carried into the concrete with the water and may subsequently penetrate further into the concrete by diffusion. In reality, an overlap of the two mechanisms occurs as their relative importance changes with depth; diffusion, as opposed to capillary suction, becomes gradually more important as more of the concrete pores fill up with moisture. It would be reasonable to expect, therefore, that the depth of water penetration by capillary suction in a dry concrete would depend on the depth of concrete that had been influenced by drying.

Other results have showed that the greatest depth of water penetration occurs in concrete with the highest water/cement ratio, the waterfront advancing nearly 30 mm over 25 hours. As the water/cement ratio and porosity decreases and strength increases, the depth of penetration decreases and then reaches a constant of around 20 mm for strengths beyond 45 MPa.

The first exposure of surface-dried concrete to water or a chloride solution is important as a few centimetres of cover concrete can easily be penetrated. Actual concrete structures are likely, however, to be exposed to a wet environment intermittently with drying periods in-between. The cover depth of concrete which is exposed to a cyclic wetting and drying regime such as by tides or rainfall will alternate between a saturated and partially saturated state while the 'heart' of the concrete is virtually saturated. The extent of drying within the cover has a direct influence on the magnitude of the capillary forces, which in turn, are likely to dictate the rate of penetration of water during a subsequent wetting cycle. During the drying cycle, when the ambient RH is maintained at a constant level, a very steady loss of moisture occurs with the square root of time.

As with the wetting cycle, moisture loss increases with increasing water/cement ratio. For a constant temperature, wind speed and RH, all environmental factors that are likely to affect the speed of drying, the parameters most likely to influence moisture loss are porosity, pore size, pore size distribution, pore continuity and tortuosity and the presence of microcracking within the surface region.

Since drying decreases pore saturation, thereby increasing capillary suction forces, drying action and subsequent capillary absorption are intimately linked. In effect, increased drying raises the level of capillary suction forces in the dried zone which then allows greater absorption during wetting. This zone of influence, designated the convective zone varies with type of concrete, initial drying regime and water/binder ratio. It can vary between 10 mm for the better-quality concrete and 100 mm for poorer quality concrete.

Tests have further established that substantially more water or salt solution is absorbed during the first wetting cycle following a prolonged drying period in a 50% RH environment than any of the subsequent cycles. The volume uptake gradually diminishes until it reaches an almost constant level. Moisture loss during the drying cycle is considerably slower than moisture uptake. In subsequent cycles, the uptake of moisture at each wetting cycle is balanced by the moisture loss during the following drying cycle so that an approximate pseudo-equilibrium is maintained. Modelling has also shown that cyclic exposure of a 0.6 w/c concrete to high and low external RH gives a maximum convective depth of 30 mm when the cycling is between 95% RH for 9-10 days and 60% RH for 4-5 days for a total of 14 days.

If dissolved chlorides are present in the penetrating water, corrosion of the steel reinforcement can be induced which leads to cracking and spalling of the cover concrete. If corrosion of the steel in caused by ingressing chloride and the concrete is not constantly immersed in chloride-containing water such as seawater, at least occasional wetting and drying cycles must be involved so that the chlorides can penetrate in sufficient quantities down to the steel reinforcement. That is, a sufficient moisture level is maintained at the steel location for destructive corrosion to occur. The depth of cover to the steel is therefore an important parameter in the corrosion process as this needs to be bridged by both chlorides and moisture.

From a wide range of techniques available, cathodic protection is accepted to be the only technique that can guarantee corrosion protection. A way of achieving cathodic protection is by the use of galvanic sacrificial anodes connected directly to the steel reinforcement and sacrificially corroding to avoid corrosion of the steel. Traditionally, galvanic anodes, usually consisting of a zinc core encased in an activating medium, are buried within the concrete with a minimum depth of the adjacent steel reinforcement. This ensures that the moisture level around the anode is similar to or matches that of the steel reinforcement. Otherwise, drying of the concrete around the anode to levels lower than around the steel will increase the resistivity between the anode and the steel and will restrict current flow between the two metals. Surface applied anodes typically suffer from this imbalance of moisture, the anode losing its moisture to the atmosphere and essentially becoming inactive.

Some surface anodes such as a layer of zinc sheet placed on the surface of the concrete, make use of a moisture retaining/absorbing gel placed between the inner face of the zinc and the concrete surface, which also contains the anode activator.

Major problems are experienced, however, as moisture build up within the gel causes expansion and loss of bond from the underlying concrete. One other attempt to apply external anodes, in this case inert anodes for impressed current cathodic protection, is by encasing them in a moisture retaining case and occasionally injecting a moisture retaining layer with liquid.

The arrangement disclosed hereinafter makes use of the natural wetting and drying cycles that the steel reinforced concrete element is experiencing. If the steel is lying within a minimum depth of cover and is experiencing corrosion, it is evident that moisture is available at that particular depth. As mentioned above, the galvanic anode should be installed at a matching depth, which of course cannot be the case if it is positioned on the concrete surface. A novel way of artificially achieving an equivalent cover as the steel reinforcement is to contain the anode in a water-proof housing, fixed to the surface of the concrete, that extends beyond the anode on either side by a minimum length equivalent to the cover depth. The wetting and drying effects are then approximately the same for the anode as for the steel which would lie at the same effective distance away from the surface of the concrete.

DETAILED DESCRIPTION

Figure 1:
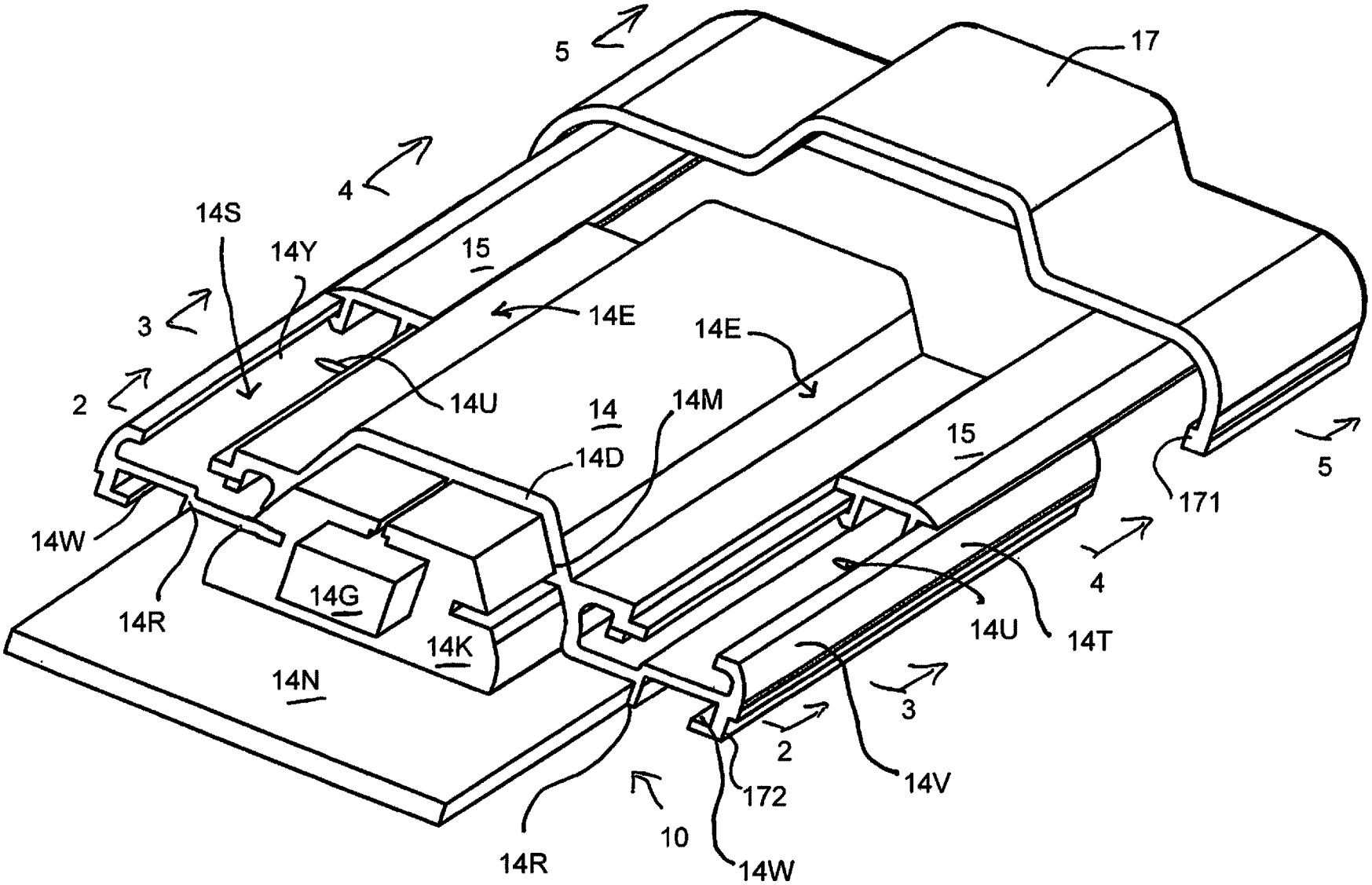
FIG. 1 is an isometric view of one embodiment of an anode apparatus for mounting on the surface of a concrete structure for use in cathodic protection of steel components in the concrete structure, the anode apparatus being pre-manufactured and assembled prior to attachment to the structure and the anode apparatus including separate components for mounting, for covering wires from the anode and screw holes, and for acting as an end cap.

The arrangement herein provides an anode apparatus 10 which is pre-assembled for mounting on an external surface 11 of a concrete structure 12 to provide cathodic protection for one or more metal components 13 within the concrete structure.

The apparatus includes a main body 14, a covering strip 15 which can be engaged onto the main body to cover mounting holes in the main body, a mounting strip 16 and an end cover panel 17. The covering strip 15 can also act to cover wires from the anode including connector wires, monitoring wires 151 and reference electrode wires 152 contained within a recess of yjr, som body 14 where required.

Figure 2:
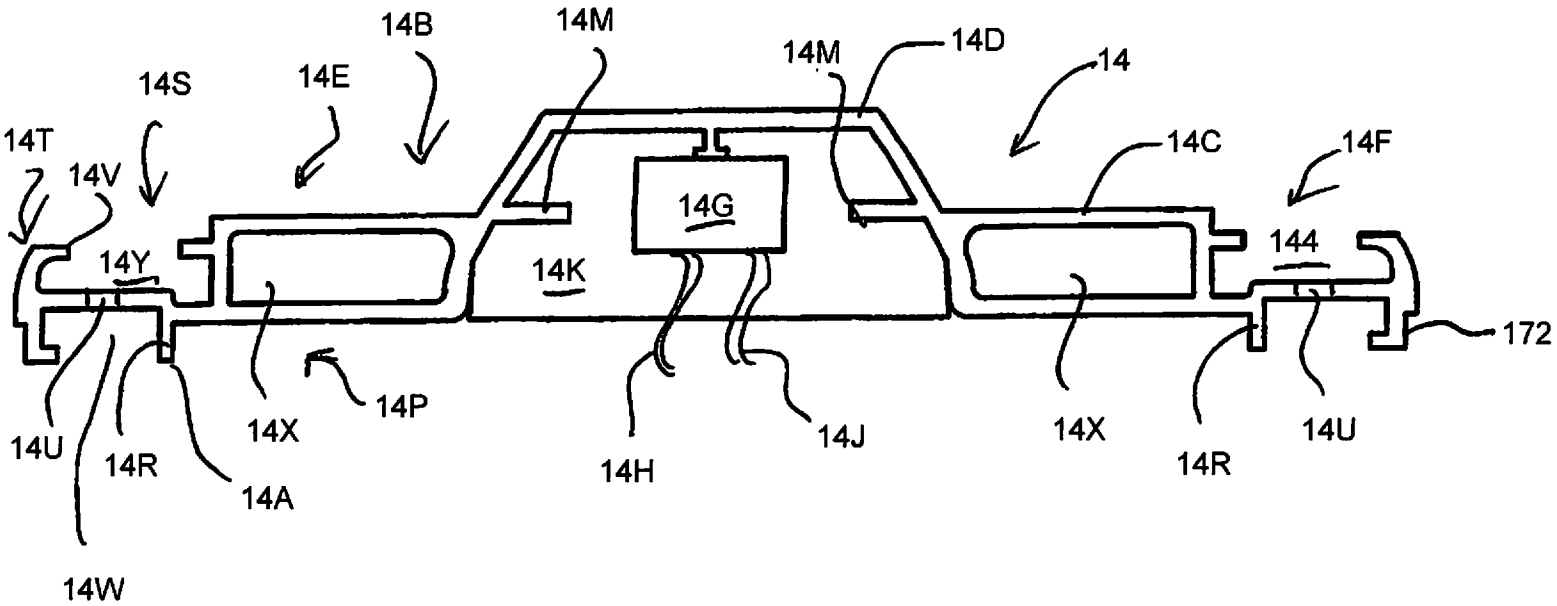
FIG. 2 is a cross-sectional view along the lines 2-2 of FIG. 1 showing the preassembled anode apparatus prior to attachment to the concrete surface.
Figure 3:
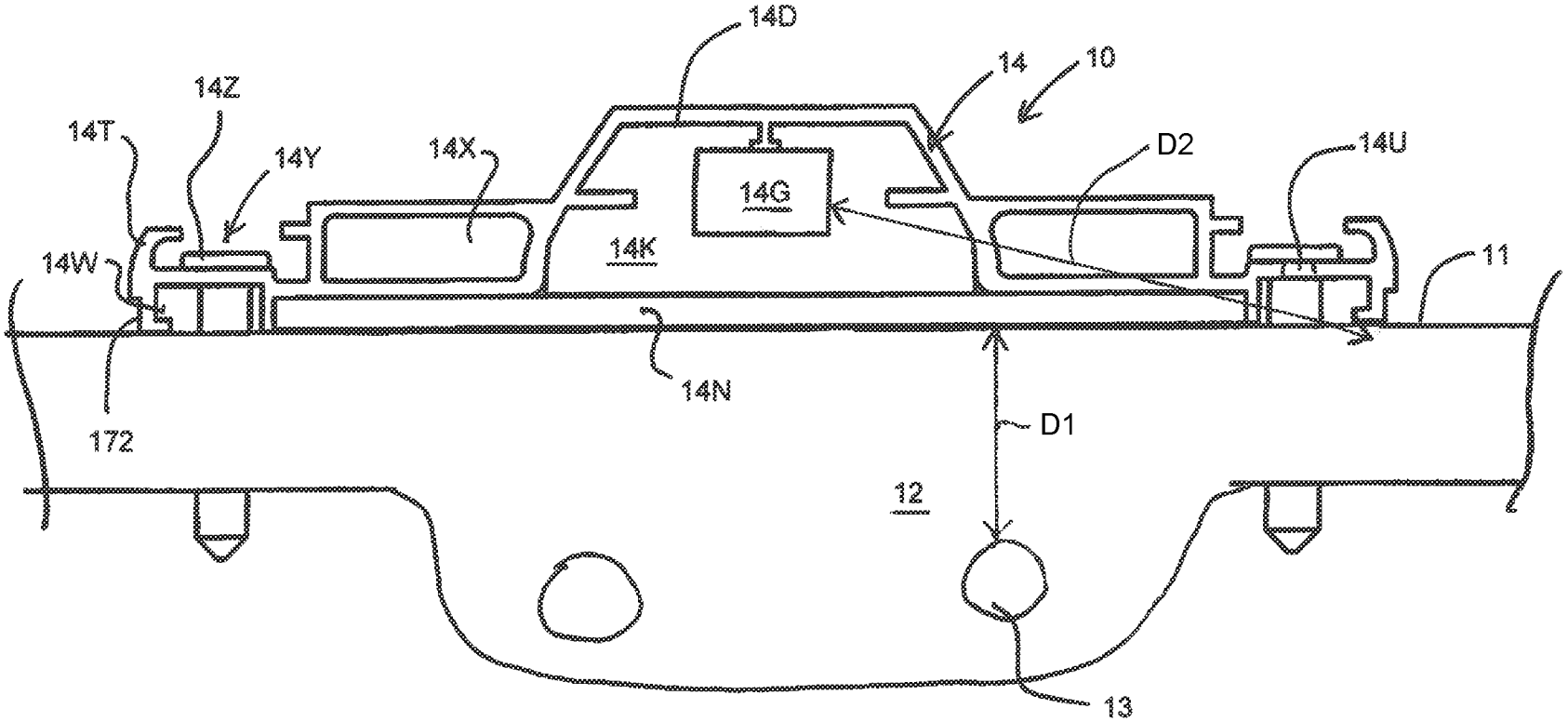
FIG. 3 is cross-sectional view along the lines 3-3 of FIG. 1 showing the preassembled anode apparatus after attachment to the concrete surface.
Figure 4:
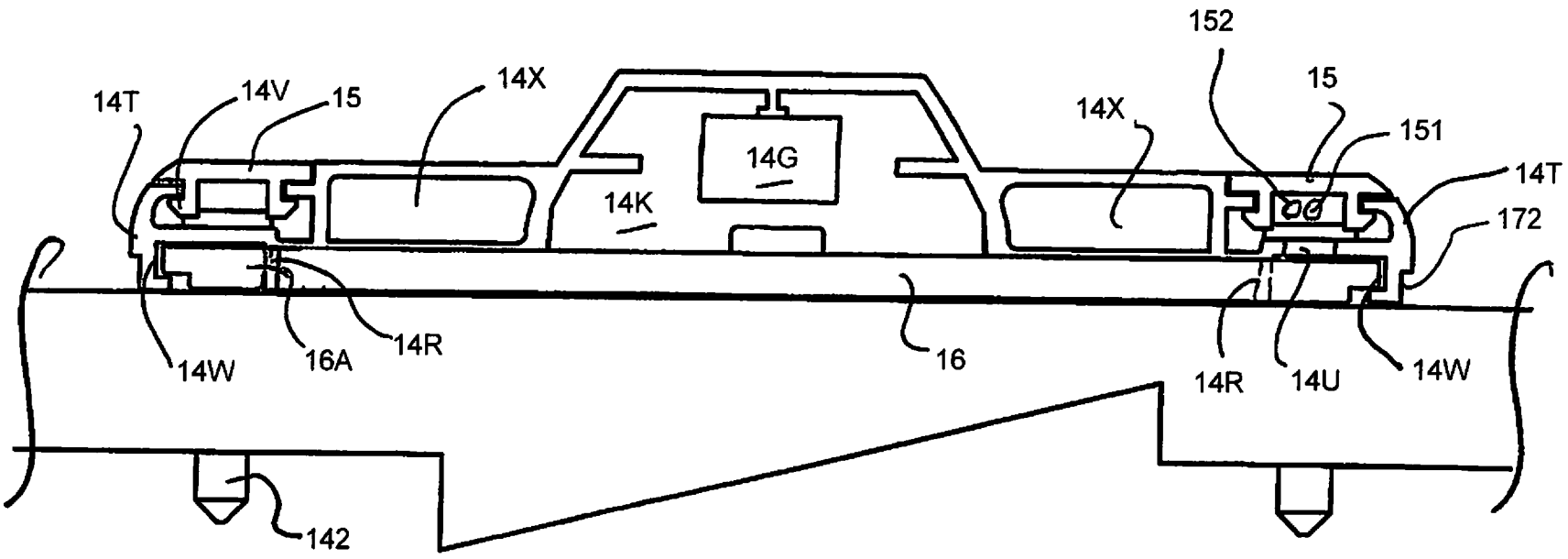
FIG. 4 is cross-sectional view along the lines 4-4 of FIG. 1 showing the preassembled anode apparatus after attachment to the concrete surface and with the cover strips in place.

The main body 14 is best shown in cross-section in FIG. 2 and comprises a pre-assembled anode apparatus defining an elongate body having a front face 14A for attachment to the external surface 11 and a rear face 14B facing away from the concrete structure. The main body is primarily defined by an extruded strip 14C of an impermeable material such as a suitable plastic. The extruded strip can be of an electrically insulating material to cover any exposed conductors, but this is not essential. As the main body is typically extruded, it can be elongate in shape, but this is not necessarily so and it can be rectangular, square or even circular to surround an anode of similar shape.

The main body 14 has a raised center section 14D and two side wing sections 14E and 14F. within the raised section 14D is provided an elongate anode 14G carried on the elongate body and extending at least partly therealong. Typically the anode extends along the full length and includes connecting wires 14H and 14J at one or both ends for electrical connection to the steel, to the next anode and/or to a power supply as required.

In one embodiment, the anode is formed of a material such as zinc which is sacrificial relative to the metal components 13 to generate a galvanic current between the anode 14G and the metal components 13 to provide cathodic protection of the metal components. In another arrangement, the anode can be connected to a power supply so that it can optionally be of a non-sacrificial or inert material with the current for protection being provided by an impressed current rather than galvanically.

The anode is mounted in a supporting material of an ionically conductive material 14K carried on the elongate body and filling the raised section 14D so as to surround the anode which is thus embedded therein. The anode can be provided with recessed surface portions to increase the surface contact area between the anode and the supporting material 14K. The anode is located within the raised centersection of the plastic cover 14C and is spaced from the front face 14A. The supporting material is maintained in place by a pair of flanges or fins 14M projecting from the wall of the cover 14C inwardly into the body of the supporting material as it is cast in place within the cover and surrounding the anode.

In the case of an anode which is sacrificial, the supporting material 14K including an activator, of type well known to a person skilled in this art, is used for maintaining the galvanic current by promoting corrosion of the anode.

In the pre-assembled unit shown in FIG. 2, the supporting material has a front face defining the front face 14A which when mounted on the concrete surface acts to allow communication of ions from the anode through the supporting material to the metal components in the concrete.

The elongate body thus includes and is supported by the impermeable covering material 14C at the rear face of the body where the material 14C covers the anode and the supporting material. The impermeable covering material is arranged to cover the anode and the supporting material when the front face is attached to the surface of the concrete. This impermeable covering material separates the anode and the supporting material from the environment including any surrounding moisture from rain, splashing and tidal action.

The anode apparatus shown in FIG. 2 is arranged to be handled, transported and installed as a common assembly with the structure being sufficiently robust to accommodate the forces involved while maintaining the structure as an elongate linear body. The structure can be formed in different lengths if required for particular installations or can be connected end to end as discussed hereinafter.

The structure is arranged to be mounted on the front face of the concrete as a standalone body leaving other parts of the surface exposed. It is of course important that the front face of the supporting material is in intimate ionic contact with the surface of the concrete to ensure effective ion communication between the anode and the steel. For this purpose, the main attachment is provided by a layer 14N of an adhesive material. This is flexible or conformable when applied so as to accommodate variations in the surfaces and is arranged to cure after installation to form an integral body between the concrete surface and the elongate body including the anode. In one preferred arrangement, the adhesive material can be applied by trowelling material onto the front face 14A to a required thickness following which the anode apparatus is applied onto the surface. The adhesive material may be a suitable cement based mortar, but can include other materials which are conformable, adhesive and ionically conductive.

The fastening arrangement includes a channel 14P for receiving the adhesive defined by two flanges or beads 14R projecting downwardly from the front face by a height equal to the desired thickness of the adhesive. This provides therefore a guide for the user to apply the adhesive to the required thickness. The adhesive is thus arranged to attach between the supporting material and the surface.

As an alternative not shown, the adhesive can be proved as a part of the anode apparatus as a pre-applied layer and covered by a release sheet.

The impermeable covering material thus has the raised center section under which the supporting material and anode is housed and two side sections 14S for engaging the surface on either side of the supporting material. The wall sections extend outwardly from the raised section to outer edge 14T. the beads 14R extend downwardly from the walls 14S at a position spaced outwardly from an inner edge of the wall 14S so that a part of the wall 14S is attached to the surface of the concrete by the adhesive layer 14N. The wall sections 14S extend outwardly from the beads 14R along the surface of the concrete to cover any adhesive escaping from the bead due to pressure or slight overfilling used to ensure full coverage.

The cover 14 further includes stiffening cavities 14X on each side of the raised center 14D and inward of the channels 14Y which receive the wires 151 and the fastening screws to be covered by the strips 15. In this way the extruded cover is relatively stiff and can lie flat on the surface of the concrete with the underside of the material 14K and the underside surface 14S bonded to the surface of the concrete by the applied adhesive layer.

In order to provide a more secure attachment of the elongate body and to hold the body in place during and after curing of the adhesive, the impermeable covering material includes fastener holes 14U at locations thereon outward of the beads 14R so as to be outward of the adhesive and spaced from the supporting material 14K. The holes allow screw fasteners to pass to engage into the concrete.

In order to provide a fully attractive and smooth rear face exposed on the concrete surface, the insert strips 15 engage over the holes and are retained on the body as a snap fit or as a sliding fit at the channels 14Y with cooperating projections 14V which locate the strip in the channel. These can also cover the wires as described above which can be retained, protected and hidden by the insert strips.

Figure 5:
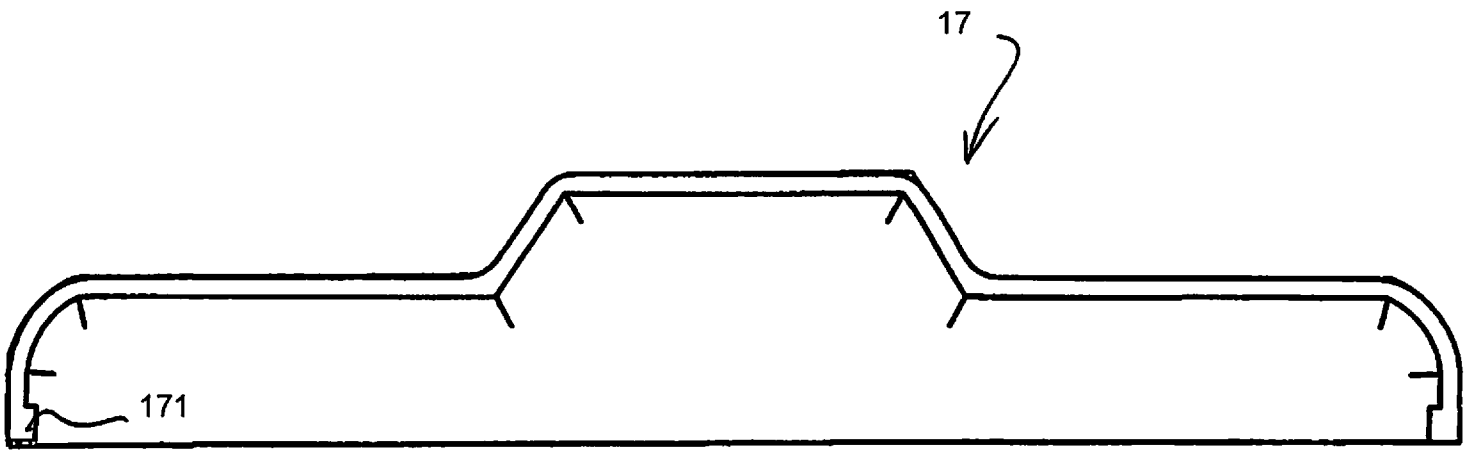
FIG. 5 is cross-sectional view along the lines 5-5 of FIG. 1 showing the preassembled anode apparatus after attachment to the concrete surface and showing the mounting bracket attached to the concrete surface and engaging the anode apparatus for alignment and support thereof.

As shown in FIGS. 1 and 5 the separate end cover 17 is provided and arranged to engage onto the impermeable covering material and cover an end face of the impermeable covering material at one end of the elongate body. The cover 17 has an interior shape matching the exterior of the elongate body and the cover material thereof and includes engagement lips 171 for attachment to the impermeable covering material at recesses 172 at the end of the elongate body. This can slide into place from the end or can snap over the sides of the body. The end cover can be used to bridge across ends of two end to end elongate bodies (not shown) and to cover the attachment wires at one end of the anode for connection to the metal components.

As an option to provide simple mounting of the elongate body on the concrete surface, there is provided the attachment member 16 for attachment to the concrete prior to the mounting of the body on the concrete. This can be mounted at set locations to act as a guide to properly align and locate the body. This includes at least one mounting leg 16A which when attached extends along a portion of the surface longitudinally of the intended location of the elongate body for attachment to and support of the elongate body when applied on the concrete. Thus the attachment member is mounted at an intended location of one end of the body following which the body is slid into place on the leg 16A with the leg being received in a receptacle 14W in the body between the outer edge 14T and the bead 14R. The impermeable body may include at least one longitudinally extending cavity or channel therein which can be defined by the receptacle 14W which is located at the concrete surface to retain moisture passing along the body after installation to help maintain moisture at the support material 14K which maintains galvanic activity. The outer edges 14T at the recesses 172 can provide a location for an additional sealing bead of sealant or calking material (not shown).

The arrangement herein can be used in a method where the predetermined distance D1 between the surface of the concrete and the steel 13 is arranged to match said predetermined distance D2 between the edge of the cover 14C and the anode 14G at the center of the cover at such that wetting and drying effects are the same for the anode as for the metal components.

The invention claimed is:

1. A concrete assembly and an anode apparatus mounted thereon, the assembly comprising:

a concrete structure having one or more metal components within the concrete structure;

the concrete structure having a planar mounting face defining a plane on which the anode apparatus is mounted;

the anode apparatus comprising:

a body having a front face mounted on the planar mounting surface and a rear face facing away from the mounting surface of the concrete structure;

the body and the front face thereof being arranged so that no portion of the body extends beyond the plane of the planar mounting surface;

an anode carried on the body;

the anode being formed of a material which is sacrificial relative to the metal components to generate a galvanic current between the anode and the metal components to provide cathodic protection of said one or more metal components;

an ionically conductive supporting material carried on the body and engaging the anode;

the supporting material having a front face arranged to allow communication of ions from the anode through the supporting material to the metal components in the concrete;

the body including an impermeable covering material at the rear face covering the anode and the supporting material with the impermeable covering material extending to positions on respective sides of the anode at the planar mounting surface of the concrete structure;

and an adhesive material distinct from and attached to the supporting material and connecting the supporting material and the body to the planar mounting surface of the concrete structure.

2. The concrete assembly according to claim 1 wherein the body defines a channel recessed relative to said positions of the impermeable covering material at the planar mounting surface, the recessed channel having a depth of the channel from the plane of the planar mounting surface of the concrete structure to the supporting material and receiving the adhesive material.

3. The concrete assembly according to claim 2 wherein the channel is defined by two spaced walls each extending from the plane of the supporting material to the plane of the planar mounting surface and arranged to confine the adhesive material therebetween.

4. The concrete assembly according to claim 3 wherein the two walls are spaced inwardly from said positions of the impermeable covering material at the planar mounting surface.

5. The concrete assembly according to claim 3 wherein the two walls are spaced inwardly from the side edges to define outer cover portions extending outwardly from the walls to cover adhesive escaping from the bead.

6. The concrete assembly according to claim 1 wherein the impermeable covering material includes flanges extending into and engaging the supporting material for maintaining the supporting material and the anode therein within the body.

7. The concrete assembly according to claim 1 wherein the impermeable covering material includes fastener holes through which screw fasteners can pass to engage the concrete structure.

8. The concrete assembly according to claim 1 including a separate end cover arranged to engage onto the impermeable covering material and cover one end of the body.

9. The concrete assembly according to claim 8 wherein the end cover includes engagement lips for attachment to the impermeable covering material.

10. The concrete assembly according to claim 8 wherein the end cover is arranged to bridge across ends of two bodies.

11. The concrete assembly according to claim 8 wherein the anode includes one or more attachment wires for connection to said one or more metal components and wherein the end cover is arranged to cover said one or more attachment wires.

12. The concrete assembly according to claim 1 wherein there is provided an attachment alignment member for attachment of the body to the concrete structure which includes at least one mounting leg extending along the planar mounting surface longitudinally of the elongate body for alignment and support of the body on the concrete structure.

13. The concrete assembly according to claim 1 wherein the body defines two side edges each spaced from a center line of the body where the anode is located along the center line so as to be spaced from each side edge of the body and wherein the positions on respective sides of the anode at the planar mounting surface of the concrete structure are defined by said side edges.

14. A concrete assembly and an anode apparatus mounted thereon, the assembly comprising:

a concrete structure having one or more metal components within the concrete structure;

the concrete structure having a planar mounting surface defining a plane on which the anode apparatus is mounted;

the anode apparatus comprising:

a body having a front face mounted on the planar mounting surface and a rear face facing away from the planar mounting surface of the concrete structure;

the body and the front face thereof being arranged so that no portion of the body extends beyond the plane of the planar mounting surface;

an anode carried on the body;

the body including an impermeable covering material at the rear face covering the anode and the supporting material with the impermeable covering material extending to positions on respective sides of the anode at the planar mounting surface of the concrete structure;

an ionically conductive supporting material carried on the body and engaging the anode;

the supporting material having a front face arranged to allow communication of ions from the anode through the supporting material to the metal components in the concrete;

the front face of the supporting material being spaced from the plane of the mounting surface of the concrete structure;

wherein the body includes two parallel walls which define therebetween a channel recessed away from the plane of the planar mounting surface of the concrete structure;

and an adhesive material distinct from and attached to the supporting material received within the channel and connecting the supporting material to the planar mounting surface of the concrete structure and so as to connect the body to the planar mounting surface.

15. The concrete assembly according to claim 14 wherein the impermeable covering material extends in a direction along the planar mounting surface to a distance beyond the anode and the adhesive material to each side thereof.

16. The concrete assembly according to claim 14 wherein the adhesive material is wider than the anode and the supporting material.

17. The concrete assembly according to claim 14 wherein the two parallel walls are spaced inwardly from the side edges of the body.

18. The concrete assembly according to claim 14 wherein the impermeable material includes at least one cavity therein at or adjacent the planar mounting.

19. The concrete assembly according to claim 18 wherein the cavity receives connecting wires related to the anode.

20. The concrete assembly according to claim 18 wherein the cavity is covered by a covering strip.

21. A concrete assembly and an anode apparatus mounted thereon, the assembly comprising:

a concrete structure having one or more metal components buried within the concrete structure;

the concrete structure having a planar mounting surface defining a plane on which the anode apparatus is mounted;

the anode apparatus comprising:

a body having a front face mounted on the planar mounting surface and a rear face facing away from the planar mounting surface of the concrete structure;

the body and the front face thereof being arranged so that no portion of the body extends beyond the plane of the planar mounting surface;

the body defining two side edges each spaced from a center line of the body an anode defined by anode material carried on the body where the anode is located along the center line so as to be spaced from each side edge of the body;

the body including an impermeable covering material at the rear face covering the anode and the supporting material with respective side edges of the impermeable covering material extending to said side edges of the body and, at the side edges of the body, to a position at the planar mounting surface of the concrete structure;

wherein a distance at right angles to the center line from a side edge of the anode to the side edge of the impermeable covering material is arranged to be substantially equal to or greater than a distance of the metal components from the planar mounting surface of the concrete structure.

22. The concrete assembly according to claim 21 wherein the body includes two parallel walls which define therebetween a channel recessed away from the plane of the planar mounting surface of the concrete structure and wherein there is provided an adhesive material distinct from and attached to the supporting material received within the channel and connecting the supporting material to the planar mounting surface of the concrete structure and so as to connect the body to the planar mounting surface.

23. The concrete assembly according to claim 22 wherein the two parallel walls are spaced inwardly from the side edges of the body.

* * * * *